United States Patent [19]

Nicholson

[11] Patent Number: 4,729,482

[45] Date of Patent: Mar. 8, 1988

[54] TOWEL BARS

[76] Inventor: Robert W. Nicholson, 5217 Oak St., Oak Lawn, Ill. 60453

[21] Appl. No.: 39,947

[22] Filed: Apr. 20, 1987

[51] Int. Cl.[4] ..... A47F 5/08

[52] U.S. Cl. ..... 211/105.2; 211/6; 211/123

[58] Field of Search ..... 211/105.1, 105.2, 123, 211/87, 6

[56] References Cited

U.S. PATENT DOCUMENTS 2,374,787 5/1945 Spiegel et al. ..... 211/105.1

FOREIGN PATENT DOCUMENTS 369030 2/1923 Fed. Rep. of Germany ... 211/105.1

*Primary Examiner*—Robert W. Gibson, Jr.

*Attorney, Agent, or Firm*—Welsh & Katz, Ltd.

[57] ABSTRACT

A towel bar includes a tube and a bracket on each side of the tube. The brackets can be secured to a wall to support the tube a predetermined distance from the wall. A plurality of rollers are placed over the tube adjacent to each other. The rollers operate independently of each other, and may be multi-colored, if desired. One towel may be removed from the towel bar without displacing other towels on the bar. The rollers may be installed on the tube by consumers, without having to patch holes in the wall and create new holes.

3 Claims, 5 Drawing Figures

TOWEL BARS

This invention relates to towel bars, and more particularly, to towel bars having a plurality of adjacent rollers which operate independently of each other and span substantially the entire towel bar.

BACKGROUND OF THE INVENTION

Most commercially available towel bars have a square tube which is secured to a wall by two end brackets. The tube does not rotate. In use, one or more towels are draped over the tube and removed by pulling the towels off of the tube. Since the tube is stationary and does not rotate, the towels rub over the bar as they are removed. The friction created by this rubbing creates wear on the towels, which is undesirable. Thus, there is a need for towel bars which do not create wear on towels when the towels are removed.

A towel holder shown in U.S. Pat. No. 112,004 to Alsop includes a roller. However, only a single towel can be placed on the roller at a time, because if more than one towel were placed on the roller and only one of the towels was later removed, the rotation of the roller would displace the other towel or towels. This is undesirable because people often place more then one towel on a towel bar, and it would be discomforting if all of the towels were displaced from the rack each time any one towel were removed. Thus, there is also a need for towel bars which support more than one towel and do not displace more than one towel when a selected towel is removed.

The towel holder shown in U.S. Pat. No. 112,004 to Alsop is not adaptable to previously installed commercially available towels bars. If a commercially available towel bar were already installed, installation of the towel holder shown in U.S. Pat. No. 112,004 to Alsop would require the consumer to remove the previously installed bar, patch holes in the wall and create new holes to install the new towel holder. This is undesirable because it is time-consuming and inconvenient, and often impractical, particularly if the mounting holes of the towel bar are in plastic or ceramic tiles. It is also a problem in rental apartments, where such activities are discouraged. Thus, there a need for rollers for towel bars which can be added easily by the consumer, without patching holes or creating new holes in the wall to which the towel bar is attached.

Commercially available towel bars are usually chrome-colored, or are some other single color. They cannot be easily made multi-colored because the tubes of the bars are of one piece construction and cannot be easily colored. Thus, there is a need for towel bars which can be made in a multi-colored construction.

Accordingly, one object of this invention is to provide new and improved towel bars.

Another object is to provide new and improved towel bars which do not create wear on towels when the towels are removed.

Still another object of this invention is to provide new and improved towel bars which support multiple towels and do not displace more than one towel when a selected towel is removed.

Yet another object of this invention is to provide new and improved towel bars which can be made in a multi-colored construction.

A still further object of this invention is to provide new and improved towel bar rollers which can be added by the consumer after a towel bar has been installed, without patching holes or creating new holes in the wall.

SUMMARY OF THE INVENTION

In keeping with one aspect of this invention, a towel bar includes a tube and a bracket on each side of the tube which can be secured to a wall to support the tube a predetermined distance from the wall. The tube has a square shape, although a round shape and other shapes are also contemplated. A plurality of rollers are placed over the tube adjacent to each other. The rollers operate independently of each other, and may be multi-colored, if desired.

BRIEF DESCRIPTION OF THE DRAWINGS

The above-mentioned and other features of this invention and the manner of obtaining them will become more apparent, and the invention itself will be best understood by reference to the following description of the invention taken in conjunction with the accompanying drawings, in which.

DETAILED DESCRIPTION

Figure 1:
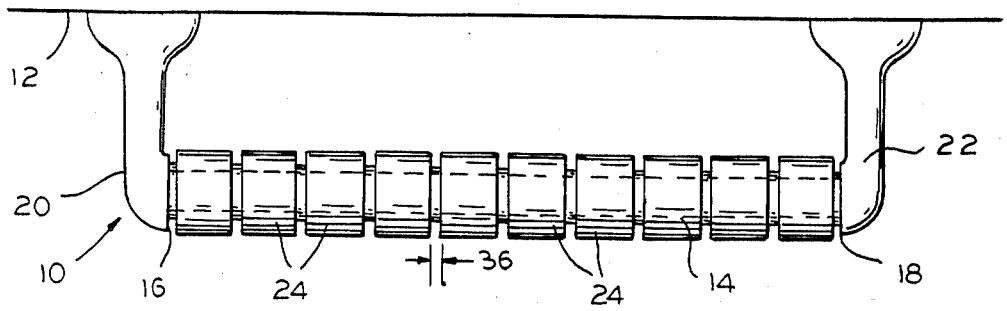
FIG. 1 is a plan view of a towel bar made in accordance wtih the principles of the invention.

As seen in FIG. 1, a towel bar 10 is secured to a wall 12 or the like in any suitable manner. The towel bar 10 includes an elongated tube 14 having two opposed ends 16,18 and a pair of brackets 20,22. The bracket 20 fits over and secures the end 16 of the tube 14, and the bracket 22 fits over and secures the end 18. The brackets 20,22 secure the tube 14 a predetermined distance from the wall 12.

A plurality of rollers 24 are placed over the tube 14 between the ends 16,18. The rollers 24 are adjacent each other, and each roller 24 rotates independently of the other rollers 24, in a manner which will be seen.

Figure 2:
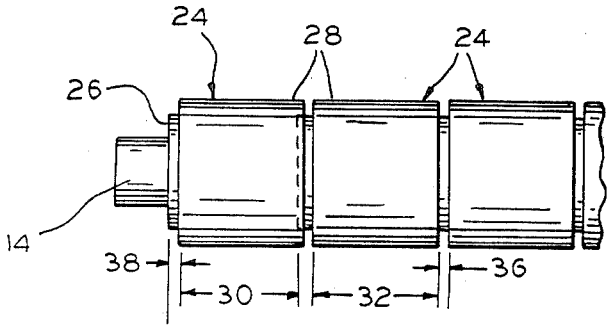
FIG. 2 is an elevational view of a portion of the tube and a plurality of the rollers in the towel bar of FIG. 1.
Figure 3:
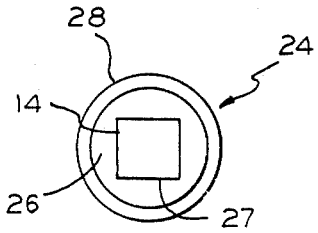
FIG. 3 is an end view of one of the rollers of FIG. 2.
Figure 4:
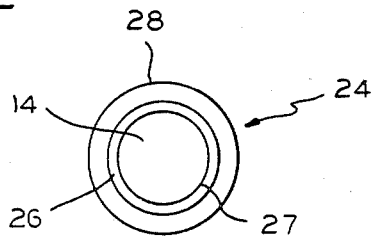
FIG. 4 shows an end view of an alternate embodiment of the roller of FIG. 3.

The tube 14 is square, as seen in FIGS. 2 and 3. While most commercially available towel bars are square, as shown in FIG. 3, other shapes, such as a round shape shown in FIG. 4, or a faceted shape (not shown), are also contemplated. The tube 14 is long enough to accommodate more than one towel, although the towels may have to be folded in order to rest on the tube 14 without overlapping each other.

A support 26 of each roller 24 has a square inside surface 27, which properly fits over the tube 14. Each roller 24 also has a cylinder 28 which is rotatably secured to the support 26. Friction between the support 26 and the cylinder 28 may be selected to provide desired resistance to turning. Towels may be removed from the bar 10 with little effort if the friction is low. With higher friction, towels will not fall off of the bar 10 if the towels are not perfectly balanced on the bar 10.

The supports 26 have a length 30, and the cylinders 28 have a length 32, as seen in FIG. 2. The lengths 32 are slightly longer than the lengths 30, so that a space 36 is created between adjacent rollers 24. For example, if the length 30 is about 2.4 inches and the length 32 is about 2.2 inches, the space 36 will be about 0.2 inches.

It can also be seen in FIG. 2 that the supports 26 and cylinders 28 are offset from each other by a distance 38. The offset distance 38 is preferably greater than the space 36, so the support 26 of one roller 24 extends inside a portion of the cylinder 28 of the adjacent roller 24.

The rollers 24 may be installed during manufacture of the towel bar 10, or by the consumer after installation of a conventional towel bar. In this manner, the rollers 24 may be installed without patching holes or creating new holes in the wall 12. This can be of particular advantage to apartment renters, for example, who may wish to use this invention in an apartment without making permanent alterations.

Figure 5:
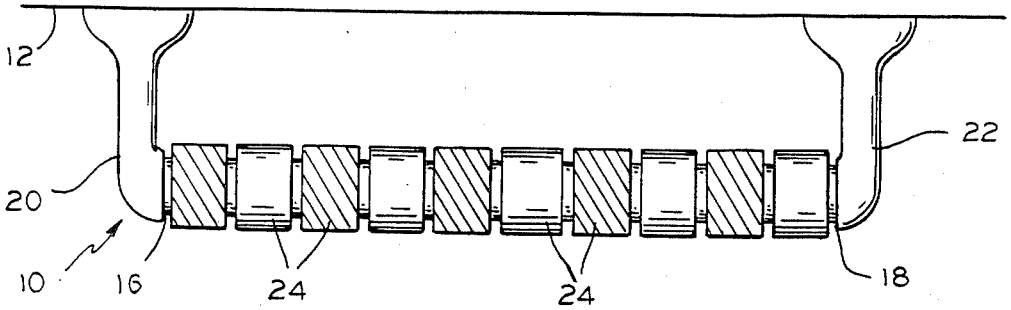
FIG. 5 shows an alternate embodiment of the towel bar of FIG. 1.

An alternate embodiment of the bar 10 is shown in FIG. 5. The rollers 24 are multi-colored, to produce a unique appearance. Contrasting colors are represented in FIG. 5 by shading. Many colors and combinations of colors are contemplated. If the rollers 24 are purchased separately and installed by the consumer, the colors and combinations of colors may be chosen and arranged in any desired manner.

The lengths 30 and 32 are selected so that enough rollers 24 are placed on the tube 14 to permit more than one towel to be placed on the bar 10. While two rollers 24 would be adequate, it is preferred that more rollers be used. It is also preferred that the lengths 30 and 32 be selected so that substantially the entire length of the tube 14 is covered, and the rollers 24 do not shift or move laterally on the tube 14.

In the embodiment shown in FIGS. 1 and 5, ten rollers 24 are provided on the tube 14. If the tube 14 extends for twenty-four inches between the end 16 and the end 18, each roller 24 will have a length 30 of about 2.4 inches. If the spaces 36 are about 0.2 inches, the lengths 32 will be about 2.2 inches.

The rollers 24 may be made of plastic or any other suitable material. The cylinders 28 may be secured to the supports 26 in any suitable manner, such as a combination of ridges and complementary depressions, retaining pins, spring clips or the like.

In operation, the rollers 24 may be installed by the consumer by removing the tube 14, installing the rollers 24 in a desired manner, and replacing the bar 10 on the wall 12. Multiple towels may be placed adjacent to each other on the bar 10. The towels will remain on the bar 10 provided that the weight of the towels is sufficiently balanced on the bar. If desired, the friction in the rollers 24 may be increased so that towels which are not balanced on the bar 10 are held in place.

The rollers 24 rotate independently of each other, so that adjacent towels are not displaced when one towel is removed. This is best achieved if adjacent towels do not share a single roller.

The many advantages of this invention are now apparent. The towel bar does not create wear on towels when the towels are removed from the bar. If more than one towel is placed on the bar, towels will not be displaced when one towel is removed. The rollers may be easily added to previously installed towel bars by the consumer, without patching holes or creating new holes, and multi-colored rollers can be installed in any desired manner.

While the principles of the invention have been described above in connection with specific apparatus and applications, it is to be understood that this description is made only by way of example and not as a limitation on the scope of the invention.

What is claimed is:

1. A towel bar comprising an elongated tube having two opposed ends, a pair of brackets, one of said brackets being securable to each of said tube ends and securable to a wall to support said tube a predetermined distance from said wall, and a plurality of rollers placed over said tube between said brackets, said rollers being adjacent to each other and operable independently of each other, each of said rollers including a support and a cylinder rotatably secured to said support, said support having an inside surface which fits over said tube and complements the shape of said tube, said cylinder being secured to the outside of said support for rotation around said support, whereby multiple towels may be placed on said towel bar and removed separately, without creating friction between said towels and without displacing other towels on said bar.

2. The towel bar of claim 1 wherein the length of said support is greater than the length of said cylinder.

3. The towel bar of claim 1 wherein said support and said cylinder are offset by a selected distance so that the support of a first roller enters the inside of the cylinder of an adjacent roller.

* * * * *